US007155847B2

(12) United States Patent
Kuroiwa et al.

(10) Patent No.: US 7,155,847 B2
(45) Date of Patent: Jan. 2, 2007

(54) SNOW REMOVING MACHINE

(75) Inventors: Kenji Kuroiwa, Wako (JP); Tsutomu Mizoroke, Wako (JP)

(73) Assignee: Honda Motor Co., Ltd. (JP)

( * ) Notice: Subject to any disclaimer, the term of this patent is extended or adjusted under 35 U.S.C. 154(b) by 0 days.

(21) Appl. No.: 11/258,814

(22) Filed: Oct. 26, 2005

(65) Prior Publication Data

US 2006/0086009 A1 Apr. 27, 2006

(30) Foreign Application Priority Data

Oct. 27, 2004 (JP) ..... 2004-312521

(51) Int. Cl.

| | |
|---|---|
| ***E01H 5/04*** | (2006.01) |
| ***G06F 7/70*** | (2006.01) |
| ***G06F 19/00*** | (2006.01) |
| ***G06G 7/00*** | (2006.01) |
| ***G06G 7/76*** | (2006.01) |

(52) U.S. Cl. ..... 37/261; 701/50

(58) Field of Classification Search ..... 37/244–261; 701/50

See application file for complete search history.

(56) References Cited

U.S. PATENT DOCUMENTS

2005/0069385 A1* 3/2005 Quenzi et al. ..... 404/114

FOREIGN PATENT DOCUMENTS

JP 4194109 7/1992

* cited by examiner

*Primary Examiner*—Christopher J. Novosad
(74) *Attorney, Agent, or Firm*—Adams & Wilks

(57) ABSTRACT

A snow removing machine including a control unit for controlling lifting and lowering of an auger housing by an electrohydraulic cylinder. The control unit has the functions of presetting per-unit-time lifting and lowering distances as constants; setting the lowest position as a lifting time measurement starting point upon lifting of the auger housing; setting the highest position as a lowering time measurement starting point upon lowering of the auger housing; measuring a time of movement from the measurement starting point depending on a lifting or lowering operation; and estimating the current vertical movement position by multiplying the lifting or lowering time with a corresponding one of the constants.

20 Claims, 12 Drawing Sheets

(LOWEST POSITION)

| LIFTING TIME Tc | MOVED POSITION Ps (COUNTED VALUE OF POSITION) |
|---|---|
| 0 sec | 0 |
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |

Pd1 Pu1 Pu2

(HIGHEST POSITION)

| LOWERING TIME Tc | MOVED POSITION Ps (COUNTED VALUE OF POSITION) |
|---|---|
| 0 sec | 7 |
| 1 | 5.75 |
| 2 | 4.5 |
| 3 | 3.25 |
| 4 | 2 |
| 5 | 0.75 |
| 5.6 | 0 |
| 7.6 | −2.5 |

Pu1 Pd1 Pd2

SNOW REMOVING MACHINE

FIELD OF THE INVENTION

The present invention relates to a self-propelled snow removing machine with travel wheels and a snow removing auger.

BACKGROUND OF THE INVENTION

This kind of snow removing machine employs a system of changing the height of an auger according to situations in snow removing operations. When the snow removing machine is moved, the bottom of the auger is raised so that it can be moved more efficiently. On the other hand, when snow is removed, the bottom of the auger is lowered so that snow can be removed more efficiently. Also, when snow is removed, the height of the auger is changed often in accordance with bumps and dips in the road surface. It is a great burden on an operator to change the height of the auger like this manually.

In some snow removing machines, augers are vertically moved by motive power to reduce the burden on an operator. An example of such snow removing machines is known from, for example, JP-4-194109A.

The conventional auger-type snow removing machine will now be described with reference to FIG. 9 hereof.

FIG. 9 is a side elevational view of the conventional auger-type snow removing machine. The removing machine 200 is a self-propelled-type working vehicle which includes a machine body 204 provided with an auger housing 203, and a travel frame 202 provided with crawlers 201, the machine body 204 being mounted vertically movably to the travel frame 202. The machine body 204 also has a front portion vertically movable by a vertical movement adjusting device 205. The auger housing 203 is provided with an auger 206.

The body 204 and the auger housing 203 can be moved vertically by moving, forward and rearward, an auger control lever 208 provided at a steering unit 207 and telescopically moving the vertical movement adjusting device 205 through a control unit (not shown). The vertical movement adjusting device 205 comprises a cylinder device.

When a cylinder device is employed for the vertical movement adjusting device 205, a drive source for driving a cylinder is required. If a hydraulic cylinder is employed, for example, a hydraulic system disposed separately is provided in addition to the hydraulic cylinder, leading to a large size. In particular, when the snow removing machine 200 is small, employing a hydraulic cylinder is disadvantageous in terms of cylinder layout space.

To make the vertical movement adjusting device 205 small, an electrohydraulic cylinder may be employed. The electrohydraulic cylinder comprises a cylinder in which a piston telescopically moves by a hydraulic pressure generated by an electric motor, and is relatively small because an electric motor and a hydraulic system are fitted in a cylinder. A control switch is turned on and off to control the electric motor such that the piston telescopically moves to thereby move the auger 206 vertically.

When snow is removed, the height of the auger housing 203 is changed often in accordance with bumps and dips in a road surface 209, and thus the electrohydraulic cylinder is operated frequently. This causes a great load on the electric motor, and develops heating in the motor. To deal with this, it may be considered to employ a continuous-duty electric motor, which is, however, expensive and becomes a factor of a cost increase in the snow removing machine.

Given this, it is conceived to provide a thermo-breaker for protection against overheat of the motor. When the heat in the motor is developed to a temperature above a certain level, a thermo-breaker included in the electric motor breaks an energized circuit to the motor.

However, since the thermo-breaker operated does not recover the energized circuit until the heat is lowered, recovery takes time. If a set operation temperature of the thermo-breaker is set low, the energized circuit to the motor is broken frequently. If a set operation temperature of the thermo-breaker is set high, the frequency of breaking is reduced, but a recovery time after breaking is long. To enable a more smooth snow removing operation, it is desirable to reduce the frequency of operation of the thermo-breaker.

SUMMARY OF THE INVENTION

It is accordingly an object of the present invention to provide a snow removing machine which can ensure sufficient durability of an electrohydraulic cylinder for moving an auger vertically, and which enables a more smooth snow removing operation.

According to the present invention, there is provided a snow removing machine comprising: a travel frame provided with travel wheels; an auger housing provided with an auger and mounted vertically movably to the travel frame; an auger-housing-lifting-lowering mechanism comprised of an electrohydraulic cylinder having a piston rod telescopically movable by an electric motor for vertically moving the auger housing; and a control unit for controlling the electric motor based on a control signal from a vertical-movement control member to thereby telescopically move the piston rod, wherein the control unit comprises: a constant setting means for presetting, as constants, per-unit-time distances of vertical movement of the auger housing, the per-unit-time distances being determined on a basis of a movable range in which the auger housing is allowed to move vertically between a lowest position and a highest position, and a full lifting or lowering time required for the auger housing to move vertically the full movable range; a time measurement starting point setting means for setting the lowest position as a lifting time measurement starting point upon lifting of the auger housing; a time measurement starting point setting means for setting the highest position as a lowering time measurement starting point upon lowering of the auger housing; a timer means for measuring, in accordance with a lifting or lowering operation of the vertical movement control member, a lifting or lowering time from the corresponding time measurement starting point; and a vertical movement position estimating means for estimating a current vertical movement position by multiplying the obtained lifting or lowering time by a corresponding one of the constants.

Thus, in the present invention, without providing a position sensor, the vertical movement position or height of the auger housing can be constantly detected. Thus, the number of components of the snow removing machine can be reduced.

Although no position sensor is provided, the electric motor can be stopped at the lowest position and at the highest position of the auger housing. Consequently, application of an excessive load to the electrohydraulic cylinder can be reduced to a minimum, and thus sufficient durability of the electro-hydraulic cylinder can be ensured.

Further, without position sensors, the vertical movement position of the auger housing can be reliably detected without being affected by snow, water drops or the like.

Furthermore, the electric motor can be quickly stopped without operating a thermo-breaker included in the electric motor. The control by time without depending on the thermo-breaker having a long recovery time can shorten a time before the electric motor is restarted. A snow removing operation can be continued without regard for the recovery time of the thermo-breaker, so that the snow removing operation can be done more smoothly.

Preferably, the control unit further comprises: an upper limit reset means for resetting the current vertical movement position to a value of the highest position when the value of the current vertical movement position is above the highest position and the vertical movement control member is operated for lowering; and a lower limit reset means for resetting the current vertical movement position to a value of the lowest position when the value of the current vertical movement position is below the lowest position and the vertical movement control member is operated for lifting.

Accordingly, in the snow removing machine of the present invention, upon lifting of the auger housing, when the current vertical movement position value becomes higher than the highest position and a lowering operation is executed, the current vertical movement position is reset to the lowest position value. Upon lowering of the auger housing, the vertical movement position can be reckoned from the highest position.

Also, upon lowering of the auger housing, when the current vertical movement position value becomes lower than the lowest position and a lifting operation is performed, the current vertical movement position is reset to the highest position value. Upon lifting of the auger housing, the vertical movement position can be reckoned from the highest position.

With this, even when the lifting or lowering speed of the auger housing is lowered for some reason, the current vertical movement position can be precisely determined. Consequently, the vertical movement position of the auger housing can be always located properly, so that a snow removing operation can be done further smoothly.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
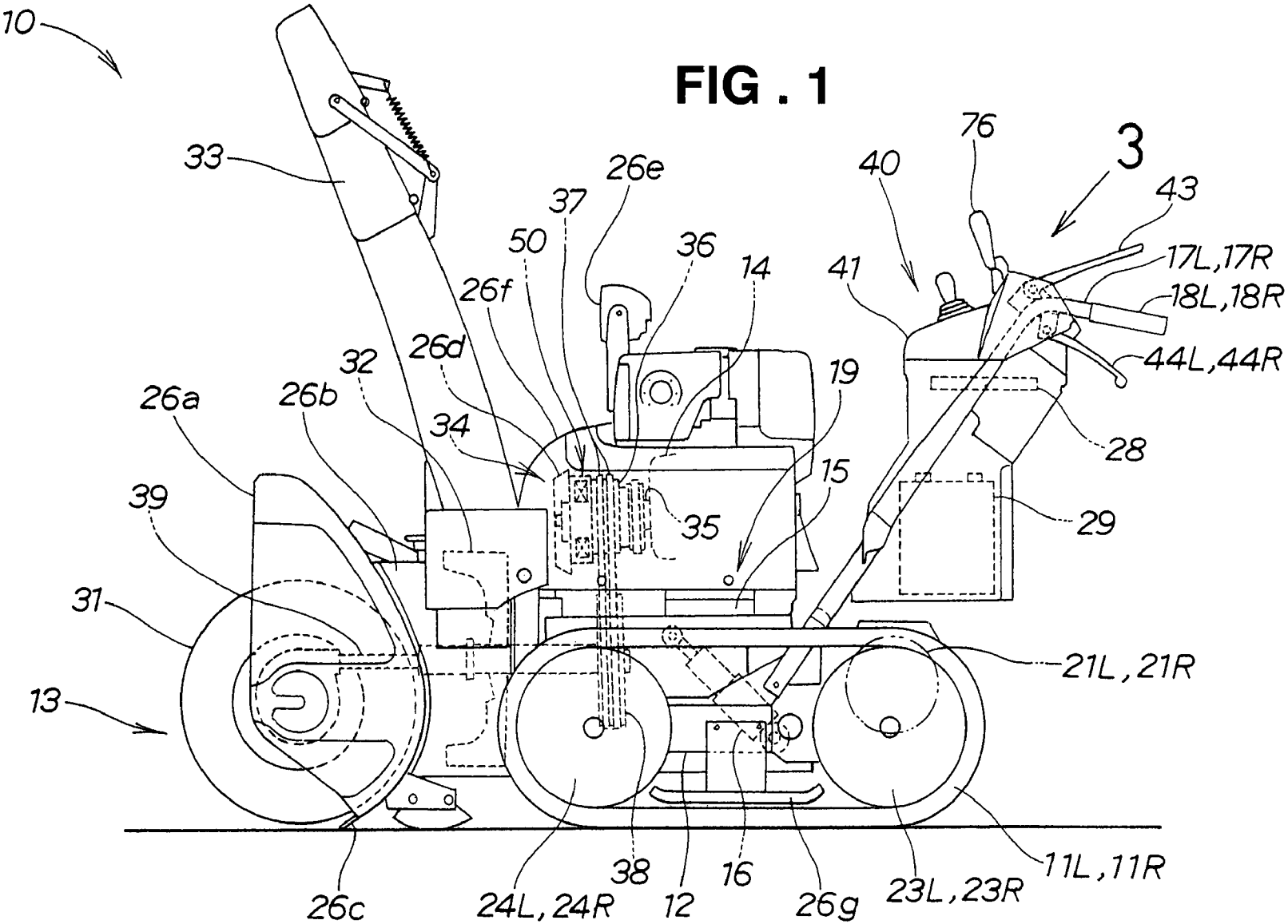
FIG. 1 is a side view of a snow removing machine according to the present invention.
Figure 2:
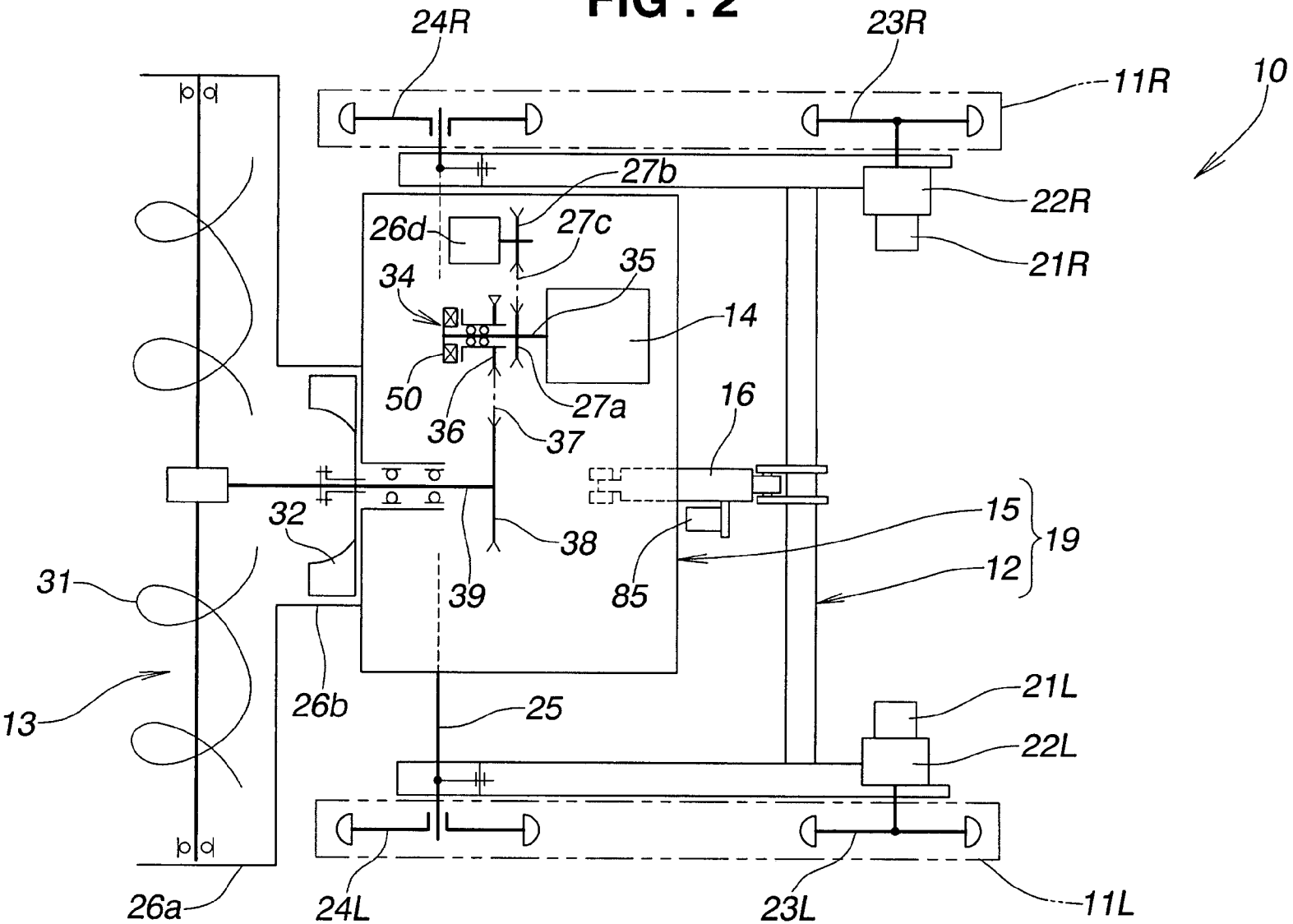
FIG. 2 is a schematic plan view of an engine, an electric motor, a snow removing mechanism and crawler belts of the snow removing machine according to the present invention.

As shown in FIGS. 1 and 2, a snow removing machine 10 is a self-propelled snow removing machine including a travel frame 12 provided with right and left crawler belts 11R, 11L; a body frame 15 provided with a snow removing portion 13 and an engine 14 for driving the snow removing portion 13, the body frame 15 being mounted on the travel frame 12 vertically movably and having a front portion moved vertically by a moving mechanism, such as an auger housing lifting-lowering mechanism 16; two right and left handles 17R, 17L extending rearward and upward from the rear of the travel frame 12; and grips 18R, 18L provided at the distal ends of the handles 17R, 17L.

An operator can operate the snow removing machine 10 with the handles 17R, 17L while walling with the snow removing machine 10.

A combined structure of the travel frame 12 and the body frame 15 constitute a machine body 19. The travel frame 12 is provided with drive wheels 23R, 23L and driven wheels 24R, 24L as travel wheels. In this embodiment, a control box 41, a control unit 28 and a battery 29 are disposed between the right and left handles 17R, 17L in this order from the top.

The snow removing portion 13 includes an auger housing 26*a* mounted to the front of the body frame 15, a blower case 26*b* integral with the auger housing 26*a*, an auger 31 provided in the auger housing 26*a*, and a blower 32 and a chute 33 provided at the blower case 26*b*.

The engine 14 is a snow removing drive source for driving the snow removing portion 13 through a snow removing power transmission mechanism 34. The snow removing power transmission mechanism 34 includes a shaft-side pulley 36 mounted on a crankshaft 35 of the engine 14 with an electro-magnetic clutch 50 interposed therebetween, a transmission belt 37, and a rotary shaft 39 on which an auger-side pulley 38 is mounted.

Power of the engine 14 is transmitted to the auger 31 and the blower 32 in a path from the crankshaft 35, to the electromagnetic clutch 50, to the shaft-side pulley 36, to the transmission belt 37, to the auger-side pulley 38, and to the rotary shaft 39. Snow raked by the auger 31 can be thrown away by the blower 32 through the chute 33.

FIG. 2 shows that drive sources (travel drive sources) of the right and left crawler belts 11R, 11L are right and left electric motors 21R, 21L; the drive wheels 23R, 23L as right and left travel wheels are disposed at the rear of the right and left crawler belts 11R, 11L; and the driven wheels 24R, 24L are disposed at the front of the right and left crawler belts 11R, 11L.

The right and left electric motors 21R, 21L transmit power through travel power transmission mechanisms 22R, 22L to the right and left crawler belts 11R, 11L. The right and left travel power transmission mechanisms 22R, 22L are reducers integrated with the electric motors 21R, 21L, respectively. Output shafts of the reducers constitute right and left drive wheel axles.

The right crawler belt 11R can be driven by a driving force of the right electric motor 21R via the right travel power transmission mechanism 22R and the right drive wheel 23R. The left crawler belt 11L can be driven by a driving force of the left electric motor 21L via the left travel power transmission mechanism 22L and the left drive wheel 23L.

In FIG. 1, reference 26*c* denotes a scraper provided at a rear lower edge of the auger housing 26*a*; 26*d*, a charging generator; 26*e*, an illuminating lamp; 26*f*, a cover; and 26*g*, a crawler belt biasing member. In FIG. 2, reference 25 denotes a driven wheel axle.

A generator pulley 27*a* is mounted on the crankshaft 35 protruded from the engine 14. A V belt 27*c* is put around the generator pulley 27 and a generator-side pulley 27*b* mounted to the charging generator 26*d*. Thus, rotation of the crankshaft 35 can be transmitted to the charging generator 26*d* via the V belt 27*c*.

Figure 3:
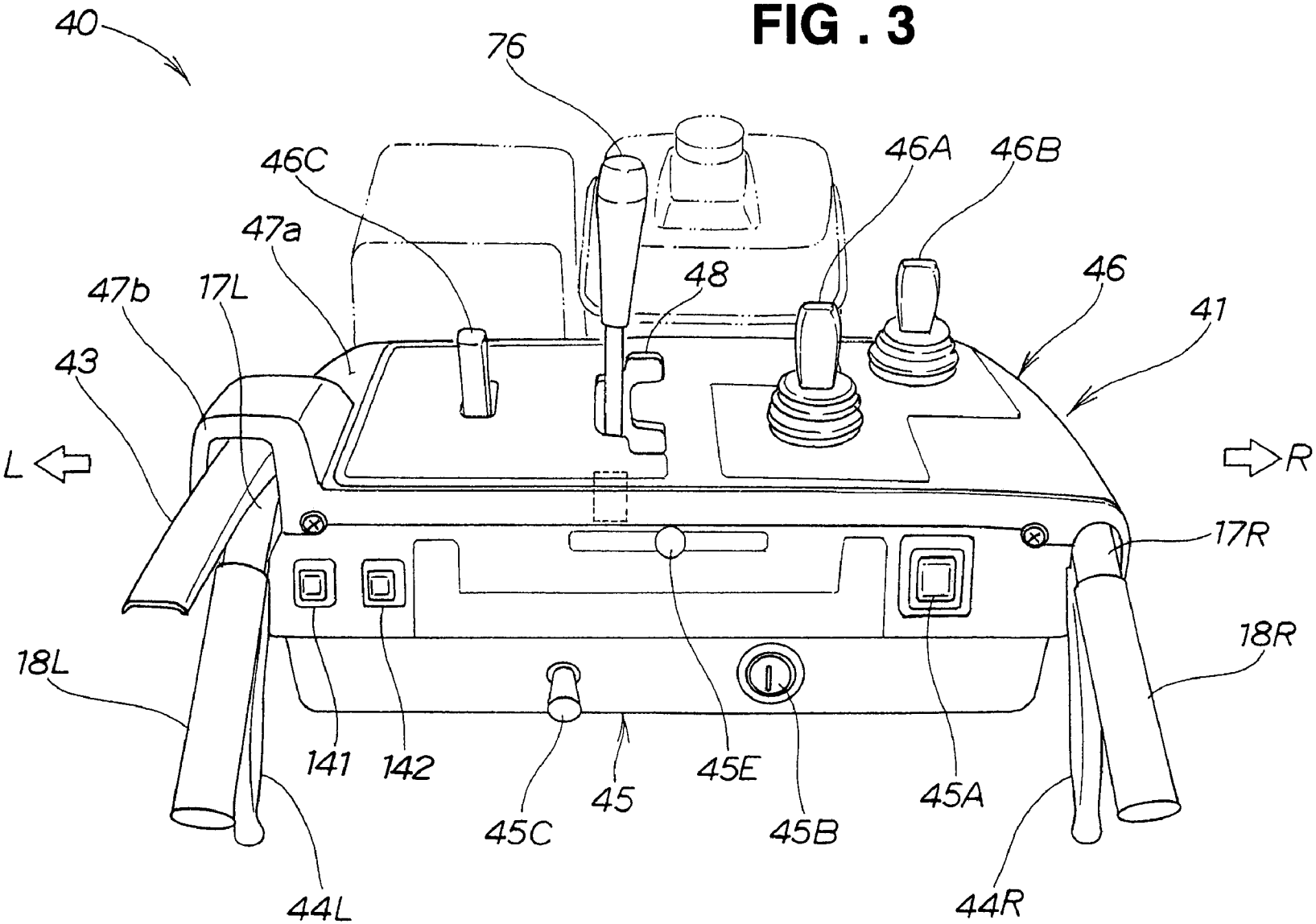
FIG. 3 is a view taken in the direction of arrow 3 in FIG. 1.

FIG. 3 is a view taken in the direction of arrow 3 in FIG. 1, and shows a perspective view of an operating unit 40.

The operating unit 40 includes the control box 41 provided between the right and left handles 17R, 17L, a right turn control lever 44R attached to the right handle 17R near the grip 18R, and a travel preparation lever 43 and a left turn control lever 44L provided at the left handle 17L near the grip 18L.

The travel preparation lever 43 is a lever for making the snow removing machine 10 ready to travel.

The control box 41 includes a control case 45 extended between the handles 17R, 17L, and a control panel 46 placed over the control case 45.

To describe it with reference to FIG. 1, the control case 45 is provided with an auger switch (clutch switch) 45A for switching the electromagnetic clutch 50 on and off, a main switch (key switch) 45B, a choke knob 45C used for starting the engine 14, a lighting button 45D for lighting the lamp 26*e*, and an up indicator light 141 and a down indicator light 142.

The control panel 46 includes a vertical movement control lever 46A for controlling the auger housing lifting-lowering mechanism 16, a chute control lever 46B for changing the orientation of the chute 33, a throttle lever 46C for controlling the rpm of the engine 14, and a forward and rearward travel speed adjusting lever 76 for controlling the electric motors 21R, 21L.

The control lever 46A is a lever mechanism which automatically returns to a neutral position shown in the figure when released. By moving the control lever 46A rearward (to the front in the figure) from the neutral position shown in the figure, a piston of the auger housing lifting-lowering mechanism 16 can be extended. By moving the control lever 46A forward from the neutral position shown in the figure, the piston of the auger housing lifting-lowering mechanism 16 can be retracted.

Reference 47*a* denotes a panel body; 47*b*, a cover; and 48, a guide hole for guiding the forward and rearward travel speed adjusting lever 76.

Figure 4:
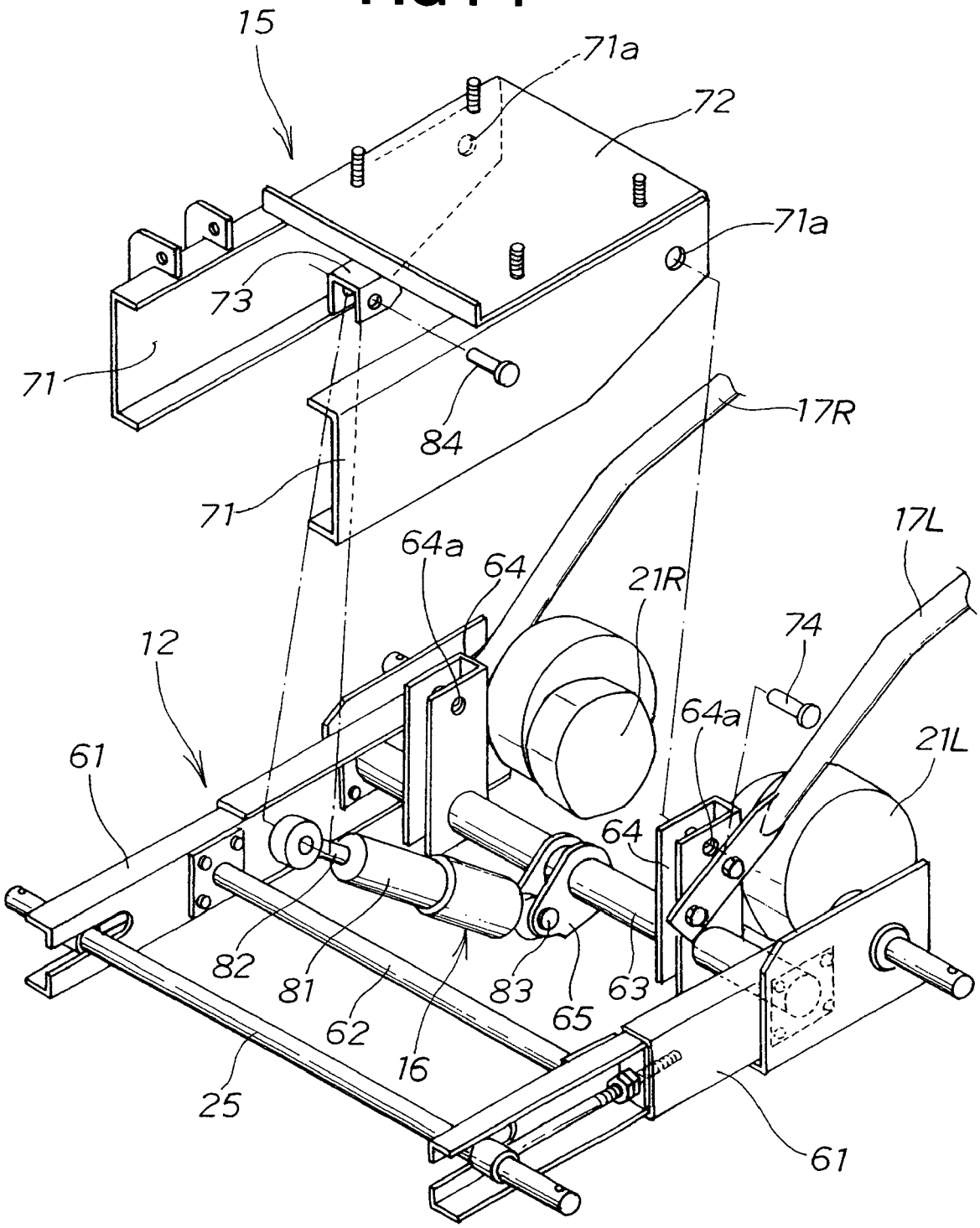
FIG. 4 is an exploded view of a travel frame, a body frame, and a frame lifting and lowering mechanism shown in FIG. 1.

FIG. 4 is an exploded view of the travel frame 12, the body frame 15 and the frame lifting-lowering mechanism 16 according to the present invention. The travel frame 12 includes right and left side members 61, 61, a front crossmember 62 and a rear crossmember 63, right and left side brackets 64, 64 mounted on the rear crossmember 63, and a center bracket 65 mounted on a middle portion of the rear crossmember 63.

Rear portions of the right and left side members 61, 61 are mounted with the electric motors 21R and 21L, and also rotatably support the drive wheel axles which are directly connected to motor shafts of the electric motors 21R, 21L. The right and left side brackets 64, 64 extend upward, and have support holes 64*a*, 64*a* passing through upper end portions thereof in a transverse direction.

The body frame 15 includes right and left side members 71, 71, a drive mounting 72 extended between the right and left side members 71, 71, and an arm 73 attached to a front middle portion of the drive mounting 72. The right and left side members 71, 71 include supported holes 71*a*, 71*a* passing through rear portions thereof in a transverse direction.

Two support pins 74 (only one shown in the figure) are inserted through the support holes 64*a*, 64*a* and the supported holes 71*a*, 71*a*, so that the rear portion of the body frame 15 can be vertically swingably mounted to the rear portion of the travel frame 12. To the travel frame 12, the auger housing 26*a* (see FIG. 1) is vertically swingably mounted via the body frame 15. Consequently, the auger housing 26*a* can be moved up and down relative to the travel frame 12.

The auger housing lifting-lowering mechanism 16 is an actuator with a piston rod 82 which can be extended from and retracted into a cylinder 81. This actuator is an electro-hydraulic cylinder of a type which extends and retracts the piston rod 82 by a hydraulic pressure generated from a hydraulic pump not shown by an electric motor 85 (see FIG. 2). The electric motor 85 is a lifting and lowering drive source integrated with a side portion of the cylinder 81 of the auger housing lifting-lowering mechanism 16.

The auger housing lifting-lowering mechanism 16 has one end (a lower portion of the cylinder 81) swingably attached to the center bracket 65 via a pin 83, and the other end (a distal end portion of the piston rod 82) attached to the arm 73 with a pin 84 to enable lifting and lowering. The front part of the body frame 15 can be moved up and down (vertically swung) by the auger housing lifting-lowering mechanism 16.

Next, the operation of the snow removing machine 10 of the above configuration will be described with reference to FIGS. 5A and 5B.

Figure 5A:
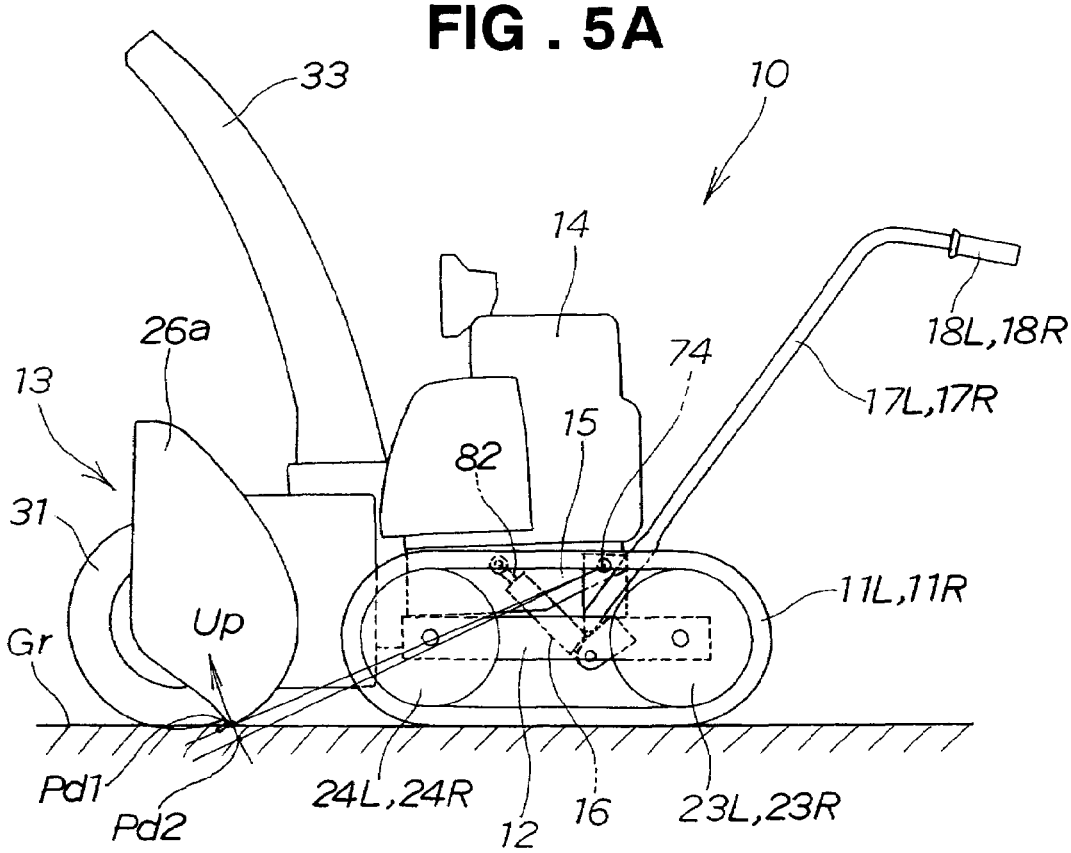
FIGS. 5A and 5B are diagrams showing an operation when an auger housing is lifted or lowered.

FIG. 5A shows the piston rod 82 of the auger housing lifting-lowering mechanism 16 in a most retracted position. At this time, the front part of the body frame 15, the auger housing 26*a* and the auger 31 are in most lowered positions. The vertical movement position (height) of the bottom of the auger housing 26*a* at this time is the lowest position Pd1. The vertical movement position of the auger housing 26*a* cannot be lower than the lowest position Pd1.

Figure 5B:
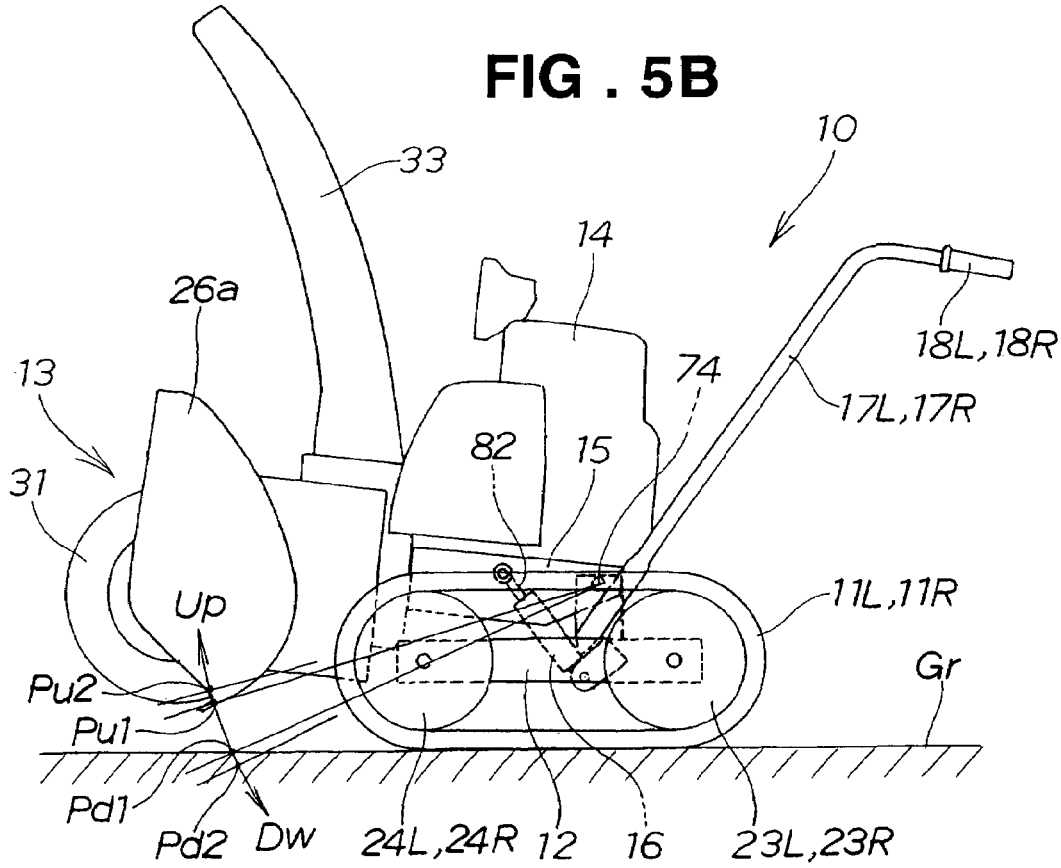

FIG. 5B shows the piston rod 82 of the auger housing lifting-lowering mechanism 16 in a most extended position. At this time, the front part of the body frame 15, the auger housing 26*a* and the auger 31 are in most raised positions. The vertical movement position (height) of the bottom of the auger housing 26*a* at this time is the highest position Pu1. The vertical movement position of the auger housing 26*a* cannot be higher than the highest position Pu1.

As described above, the control lever 46A (see FIG. 3) is moved forward or rearward to extend or retract the piston rod 82 of the auger housing lifting-lowering mechanism 16, thereby to be able to lift or lower the front part of the body frame 15, the auger housing 26*a* and the auger 31.

To move the snow removing machine 10, the bottom of the auger housing 26*a* and the bottom of the auger 31 can be raised for an efficient move. To remove snow, the bottom of the auger housing 26*a* and the bottom of the auger 31 can be lowered for efficient snow removing. Also, when snow is removed, the height of the auger housing 26*a* and the auger 31 can be changed according to bumps and dips in a road surface Gr.

When the vertical movement control lever 46A is set in the neutral position, the piston rod 82 of the auger housing lifting-lowering mechanism 16 keeps its length at that time to maintain the vertical movement positions of the front part of the body frame 15, the auger housing 26*a* and the auger 31.

Figure 6:
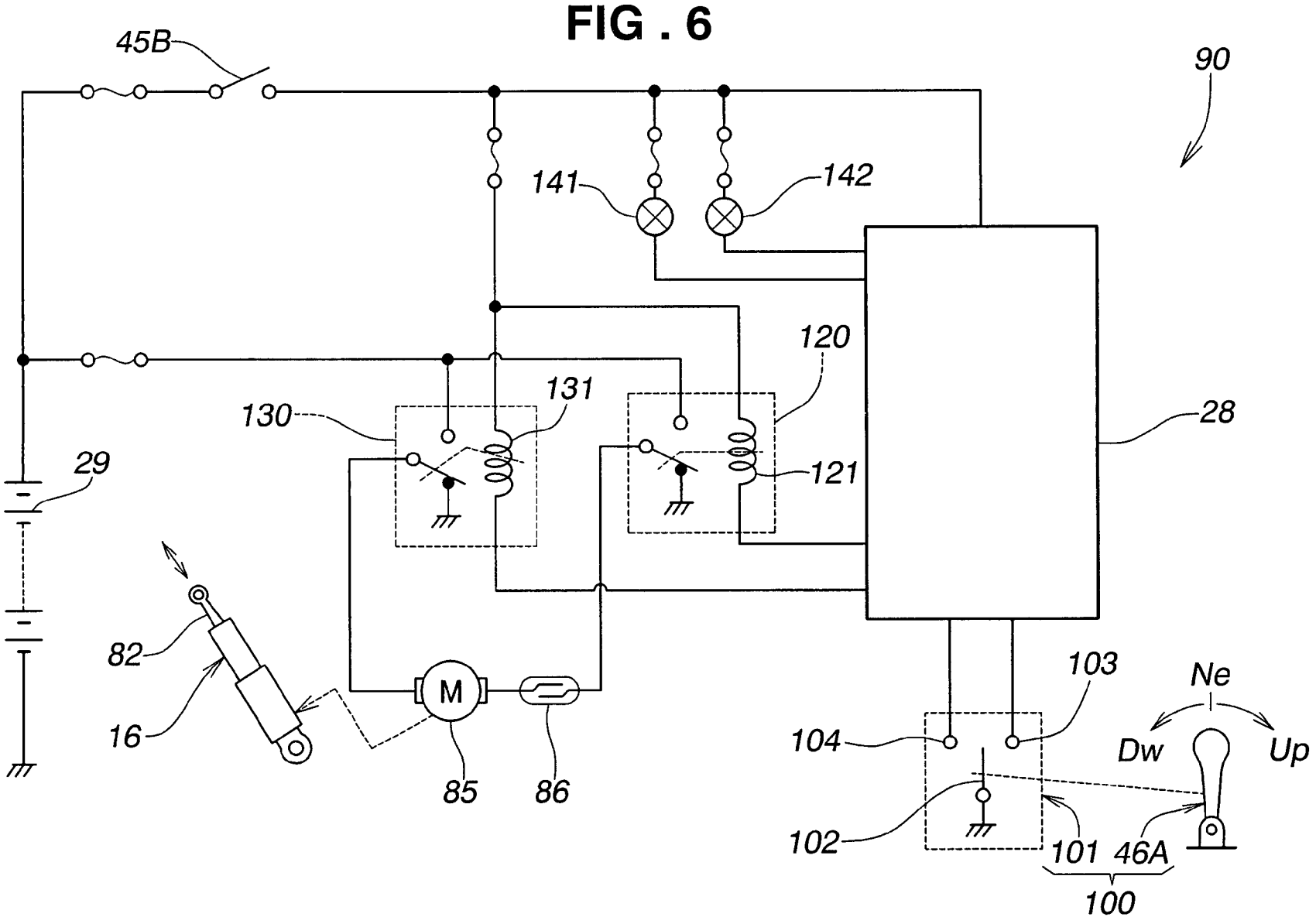
FIG. 6 is an electric circuit diagram around a control unit according to the present invention.

FIG. 6 is an electric circuit diagram around the control unit 28 in the present invention.

An electric circuit 90 has circuitry in which a vertical movement switch 100 is connected to the control unit 28; and the control unit 28, an auger lifting relay 120, an auger lowering relay 130, the up indicator light 141, and the down indicator light 142 are connected to the battery 29 via the main switch 45B. References 121, 131 denote relay exciting coils.

The switch 100 is a "vertical movement control member" with a switching mechanism 101 included in the vertical movement control lever 46A, and can control the electric motor 85 of the auger housing lifting-lowering mechanism 16 via the control unit 28.

An operation of the switch 100 is as described below.

When the control lever 46A is in a stop position (neutral position) Ne shown in the figure, a movable contact 102 is in contact with neither a first fixed contact 103 nor a second fixed contact 104. Thus, the switch 100 is off and sends a stop signal (control switch off signal).

When the control lever 46A is moved rearward from the stop position Ne, that is, moved to an up position Up, the movable contact 102 comes into contact with the first fixed contact 103. Consequently, the switch 100 turns on and sends an up signal (up control switch on signal).

When the control lever 46A is moved forward from the stop position Ne, that is, moved to a down position Dw, the movable contact 102 comes into contact with the second fixed contact 104. Consequently, the switch 100 turns on, and sends a down signal (down control switch ON signal).

The control unit 28 controls the electric motor 85 upon receipt of a control signal (stop signal, up signal, down signal) from the switch 100, thereby controlling telescopic movement of the piston rod 82 of the auger housing lifting-lowering mechanism 16.

Specifically, the control unit 28 performs controls (1) to (5) as follows:

(1) Turn off the auger lifting relay 120 and the auger lowering relay 130 when receiving a stop signal from the switch 100.

(2) Turn on the auger lifting relay 120 upon receiving an up signal when the control lever 46A is moved to the up position Up.

(3) Turn on the auger lowering relay 130 upon receiving a down signal when the control lever 46A is moved to the down position Dw.

(4) Light the up indicator light 141 when the auger lifting relay 120 is turned on, that is, the electric motor 85 is rotated normally (rotated in a lifting direction).

(5) Light the down indicator light 142 when the auger lowering relay 130 is turned on, that is, the electric motor 85 is rotated reversely (rotated in a lowering direction).

The electric motor 85 and a thermo-breaker 86 for protection of the electric motor 85 are interposed between the auger lifting relay 120 and the auger lowering relay 130. Consequently, the electric motor 85 is also controlled by the switch 100.

The thermo-breaker 86 is a protection member included in the electric motor 85 for overheat protection of the electric motor 85. The thermo-breaker 86 breaks an energized circuit to the electric motor 85 when the switch 100 is continuously operated or is frequently and intermittently operated, causing the electric motor 85 to heat (overheat) to a certain temperature.

More details are as follows. When the control lever 46A is in the stop position Ne, the auger lifting relay 120 and the auger lowering relay 130 are off. At this time, the electric motor 85 interposed between the auger lifting relay 120 and the auger lowering relay 130 is stopped.

When the control lever 46A is moved to the up position Up, the movable contact 102 of the switch 100 comes into contact with the first fixed contact 103, causing the auger lifting relay 120 to turn on. Consequently, the electric motor 85 rotates normally.

When the control lever 46A is moved to the down position Dw, the movable contact 102 of the switch 100 comes into contact with the second fixed contact 104, causing the auger lowering relay 130 to turn on. Consequently, the electric motor 85 rotates reversely.

Next, control forms of the snow removing machine 10 of the above configuration will be described with reference to FIGS. 7A and 7B.

Figure 7A:
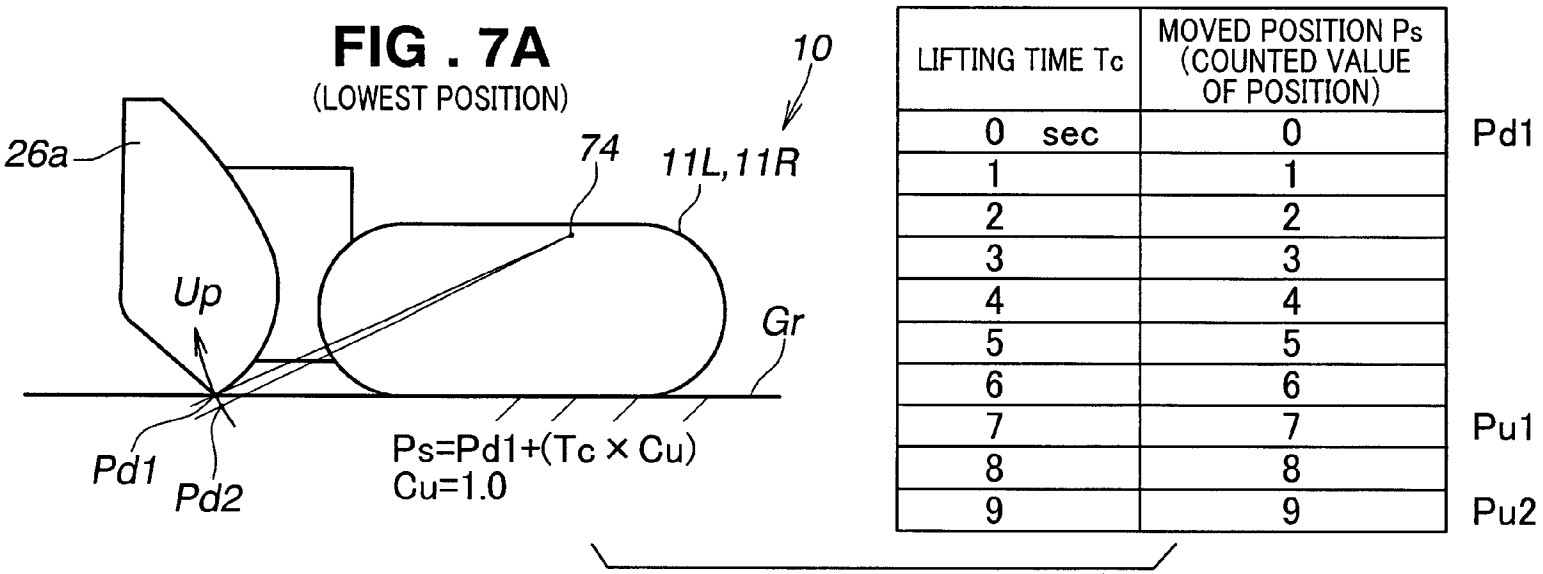
FIGS. 7A and 7B are diagrams showing forms of control between the lowest position and the highest position of the auger housing.
Figure 7B:
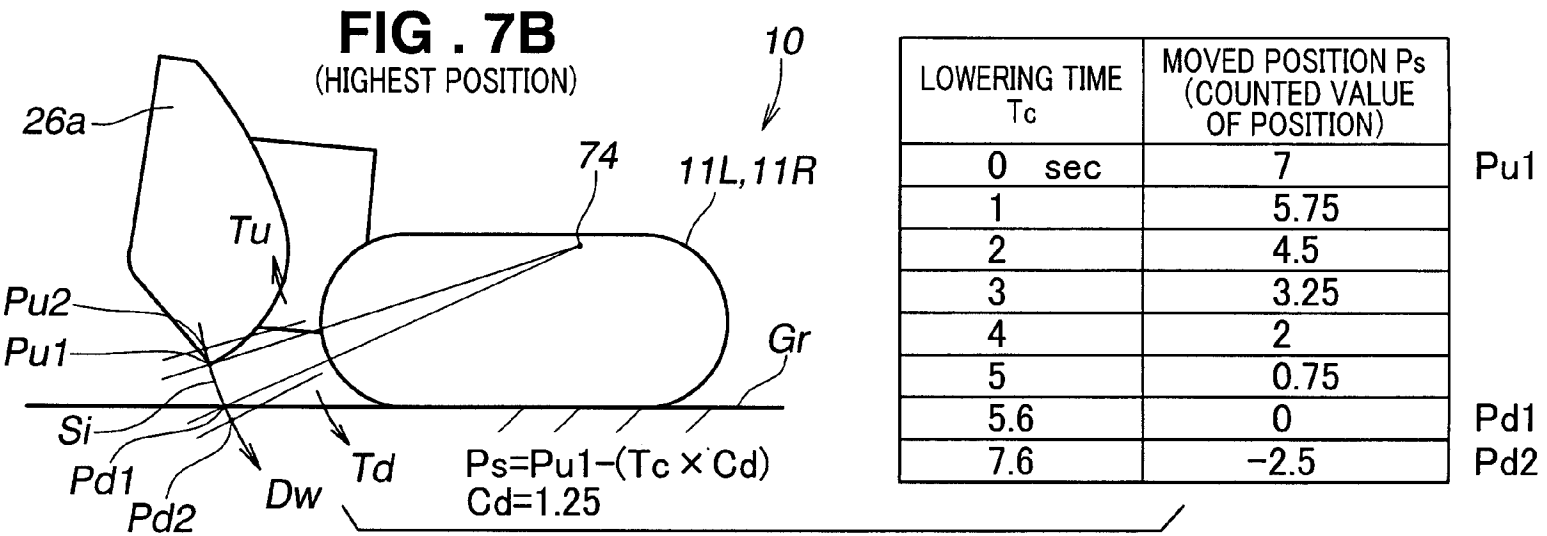

FIGS. 7A and 7B are control operation diagrams showing control forms of the snow removing machine according to the present invention. FIG. 7A shows the auger housing 26*a* lowered most to the lowest position Pd1, and is a schematic diagram corresponding to FIG. 5A. FIG. 7B shows the auger housing 26*a* lifted most to the highest position Pu1, and is a schematic diagram corresponding to FIG. 5B.

Designated by reference character Si is a movable range in which the auger housing 26*a* moves between the lowest position Pd1 and the highest position Pu1. The movable range Si is determined by a maximum stroke of the piston rod 82 in the auger housing lifting-lowering mechanism 16 shown in FIG. 5B.

Time required for the auger housing 26 to move the full movable range Si, that is, from the lowest position Pd1 to the highest position Pu1, is a full lifting time represented by Tu. Tu=7 sec., for example. A per-unit-time distance of movement, determined on the basis of the movable range Si and the full lifting time Tu, is referred to as the "for-lifting constant Cu." Cu=1.0. Suppose that the lifting speed of the auger housing 26*a* lifted by the auger housing lifting-lowering mechanism 16 (see FIG. 5) is fixed.

Upon lifting of the auger housing 26*a*, the lowest position Pd1 is a lifting time Tc measurement starting point. Upon lifting, the lifting time Tc from the lowest position Pd1 is measured, and the obtained lifting time Tc is multiplied by the for-lifting constant Cu, so that the current vertical movement position or height Ps can be estimated. That is, "Ps=Pd1+(Tc×Cu)" the results of which are shown in the table of FIG. 7A.

For example, at the time of lifting from the lowest position Pd1, the lifting time Tc is 0 sec. as shown in the table of FIG. 7A. The lifting time Tc increases as lifting progresses. The lifting time Tc at the time of lifting to the highest position Pu1 is 7 sec. A moved position Ps corresponding to the lifting time Tc is determined by multiplying the lifting time Tc at a given time by the for-lifting constant Cu.

Represented by Td is a full lowering time required for the auger housing 26*a* to downwardly move the full movable range Si from the highest position Pu1 to the lowest position Pd1. Td=5.6 sec., for example. A load applied to the auger housing lifting-lowering mechanism 16 upon lowering is smaller than upon lifting, so that Td may be smaller than Tu.

The per-unit-time distance of movement, determined on the basis of the movable range Si and the full lowering time Td, is referred to as a "for-lowering constant Cd." While Tu=7 sec., Td=5.6 sec. Thus, while Cu=1.0, Cd=1.25. Suppose that the lowering speed of the auger hosing 26*a* lowered by the auger housing lifting-lowering mechanism 16 (see FIG. 5A) is fixed.

Upon lowering of the auger housing 26*a*, the highest position Pu1 is a lowering time Tc measurement starting point. Upon lowering, the lowering time Tc from the highest position Pu1 is measured, followed by multiplying the obtained lowering time Tc by the for-lowering constant Cd, so that the current certical position Ps, that is, the height Ps can be estimated. That is, "Ps=Pu1−(Tc×Cd)" the results of which are shown in the table of FIG. 7B.

For example, upon lowering from the highest position Pu1, the lowering time Tc at a lowering starting time is 0 sec., as shown in the table of FIG. 7B. The lowering time Tc increases as lowering progresses. The lowering time Tc to the lowest position Pd is 5.6 sec. The lowering time Tc at a given time is multiplied by the for-lowering constant Cd, whereby the vertical moved position Ps corresponding to the lowering time Tc is determined.

As described above, the movable range Si for the auger housing 26*a* is determined by the maximum stroke of the piston rod 82 in the auger housing lifting-lowering mechanism 16 shown in FIG. 5B. Therefore, the moved position Ps of the auger housing 26*a* cannot be lower than the lowest position Pd1. Also, the vertical moved position Ps cannot be higher than the highest position Pu1.

In this invention, a current vertical movement position Ps is estimated based on a measured lifting or lowering time Tc. Practically, however, the lifting or lowering speed of the auger housing 26*a* may be somewhat varied by environmental influences at the time of a lifting or lowering operation. It is therefore probable that even when the control unit 28 (see FIG. 6) determines that the vertical movement position Ps has reached the lowest position Pd1 or the highest position Pu1, it actually did not. If the electric motor 85 of the auger housing lifting-lowering mechanism 16 shown in FIGS. 5A and 5B is stopped before reaching neither position, the auger housing 26*a* is stopped midway.

With this in view, an imaginary lower limit value Pd2 smaller than the lowest position Pd1 and an imaginary upper limit value Pu2 greater than the highest position Pu1 are set as shown in FIGS. 7A and 7B.

The imaginary lower limit value Pd2 and the imaginary upper limit value Pu2 are theoretical values given by adding certain allowable values to the actual lowest position Pd1 and the highest position Pu1 of the auger housing 26*a*. For example, as shown in the table of FIG. 7B, while the lowest position Pd1=0, the lower limit value Pd2=−2.5. Also, as shown in the table of FIG. 7A, while the highest position Pu1=7, the upper limit value Pu2=9. When it is determined that the movement position Ps has reached the lower limit value Pd2 or the upper limit value Pu2, the electric motor 85 is automatically stopped.

Thus, after a certain time has elapsed since the auger housing 26*a* was lifted to the highest position Pu1, and after a certain time has elapsed since the auger housing 26*a* was lowered to the lowest position Pd1, the electric motor 85 is automatically stopped, and whereby the piston rod 82 is kept in a position at that time. Accordingly, the auger housing 26*a* can be stopped certainly at the actual highest position Pu1 or lowest position Pd1.

Next, a control flow when the control unit 28 shown in FIG. 6 is a microcomputer will be described with reference to FIGS. 8A to 8D, and also to FIGS. 6 and 7. In the control flow, control is started when the main switch 45B is turned on, and control is terminated when the main switch 45B is turned off, for example.

Figure 8A:
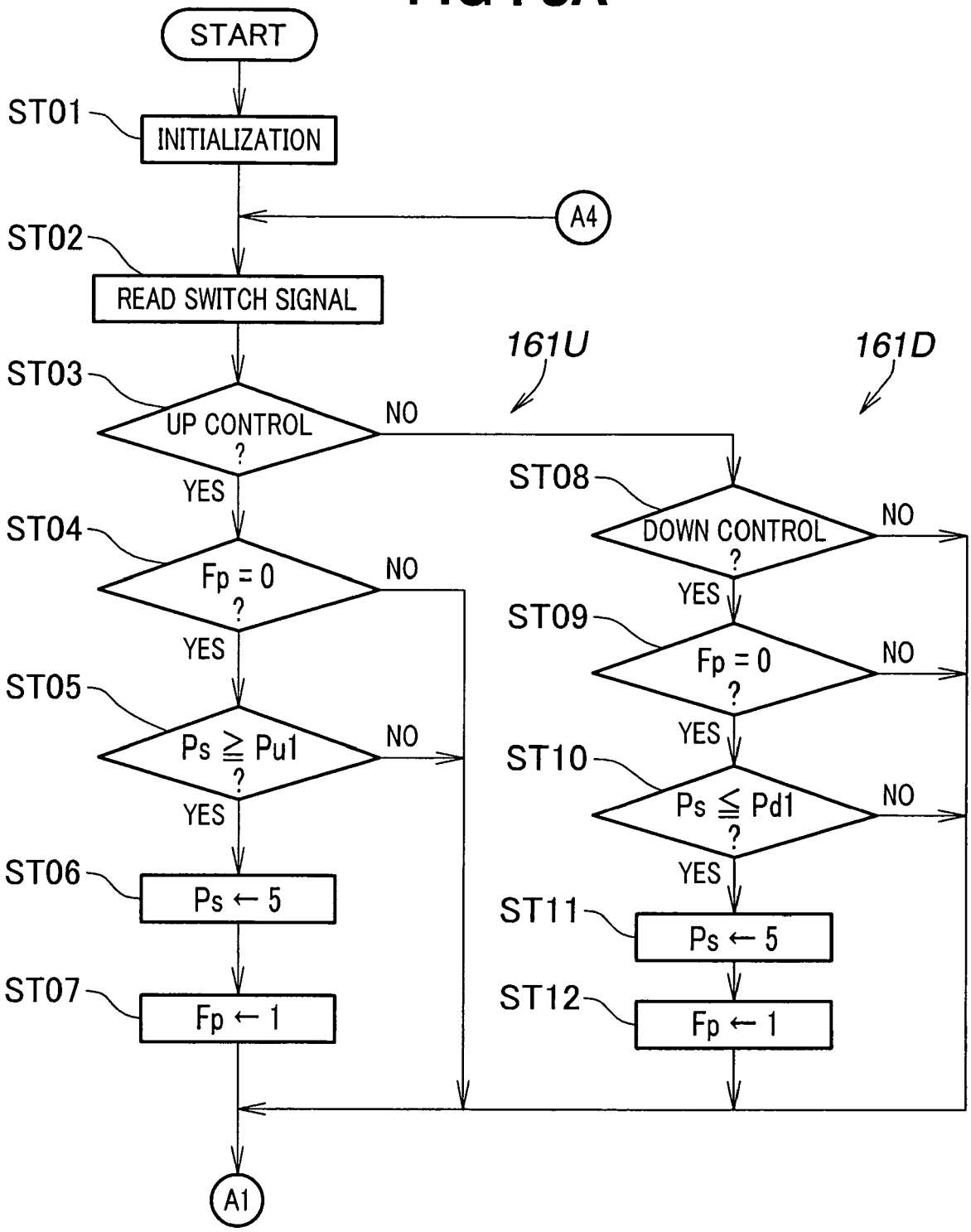
FIGS. 8A to 8D are flowcharts when the control unit shown in FIG. 6 controls the auger housing.

In FIG. 8A, step (hereinafter, abbreviated as ST) 01: Perform initialization. Specifically, flags Fp, Fmu, Fmd and Fhs are set at 0; the moved or vertical movement position value Ps is set at 2 while a control cycle count Sc is reset to 0.

ST02: Read in a switch signal from the switch 100.

ST03: Check whether the control lever 46A is moved to the up position or not, based on the switch signal from the switch 100. When it is YES, proceed to ST04, and when NO, proceed to ST08.

ST04: Check whether the vertical movement position rewrite flag Fp is "0" or not. When it is YES, proceed to ST05, and when NO, proceed to ST21 in FIG. 8B.

ST05: Check whether the vertical movement position Ps upon lifting (position count value Ps) has reached a preset highest reference value Pu1, that is, has increased to Pu1 or not (Ps≧Pu1). When it is YES, proceed to ST06, and when NO, proceed to ST21 in FIG. 8B. The highest reference value Pu1 is "+7," for example.

ST06: Set the vertical movement position Ps upon lifting at 5.

ST07: Since the lifting position count value Ps is no longer at the starting point in time, invert the position rewrite flag Fp to 1, and then proceed to ST21 in FIG. 8.

ST08: Check whether the control lever 46A is moved to the down position or not, based on the switch signal from the switch 100. When it is YES, proceed to ST09, and when NO, proceed to ST21 in FIG. 8B.

ST09: Check whether the position rewrite flag Fp is "0" or not. When it is YES, proceed to ST10, and when NO, proceed to ST21 in FIG. 8B.

ST10: Check whether the movement position Ps during lowering (position count value Ps) has reached a preset lowest reference value Pd1, that is, has decreased to Pd1 or not (Ps≦Pd1). When it is YES, proceed to ST11, and when NO, proceed to ST21 in FIG. 8B. The lowest reference value Pd1 is "±0," for example.

ST11: Set the movement position Ps for lowering at 5.

ST12: Since the lowering position count value Ps is no longer at the starting point in time, invert the position rewrite flag Fp to 1, and then proceed to ST21 in FIG. 8B.

Figure 8B:
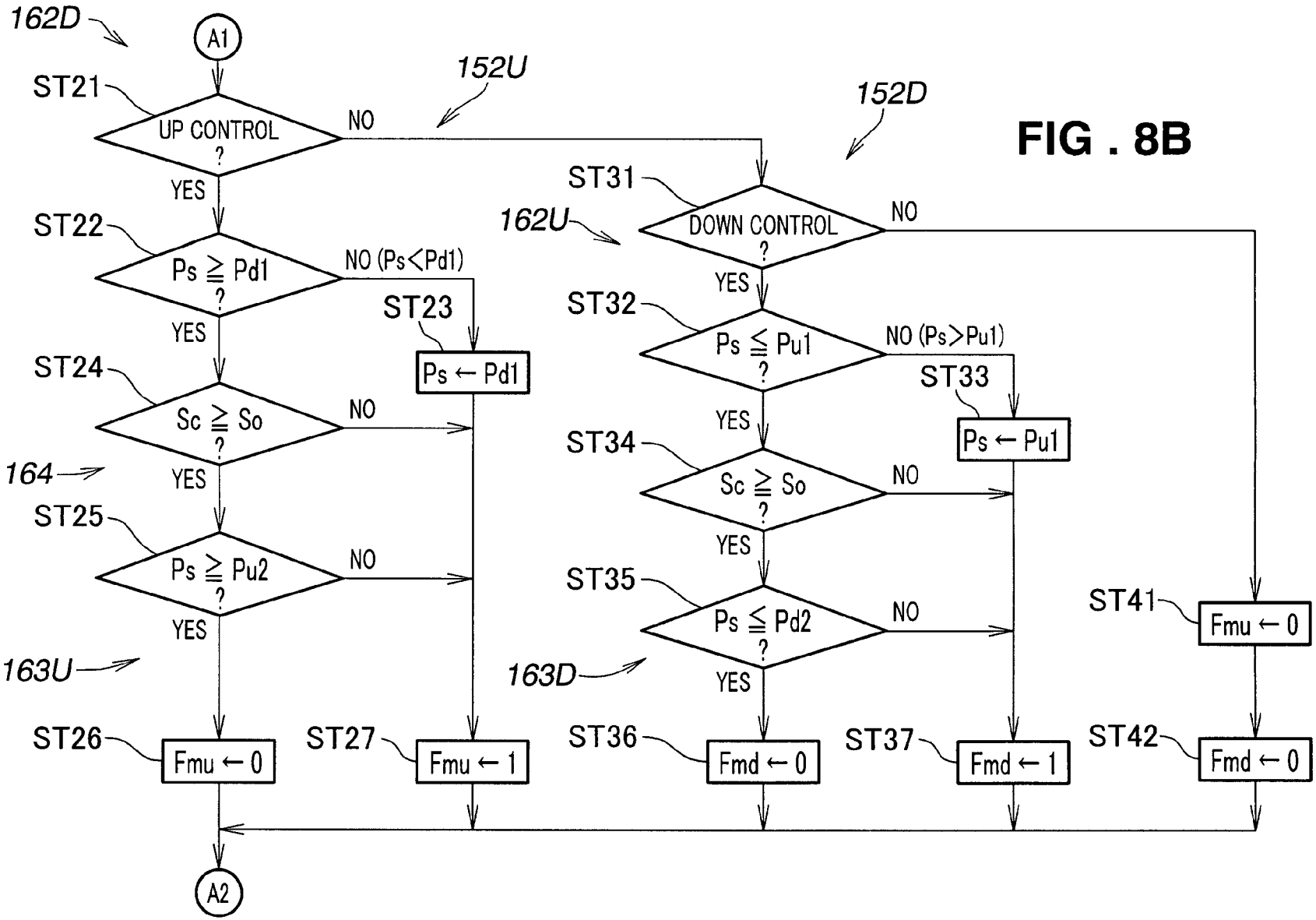

In FIG. 8B, ST21: Check whether the control lever 46A is moved to the up position or not, based on the switch signal from the switch 100. When it is YES, proceed to ST22, and when NO, proceed to ST31.

ST22: Check whether the current vertical movement position Ps is higher than or equal to the preset lowest position Pd1 or not (Ps≧Pd1). When it is YES, proceed to ST24. When NO, determine that the current vertical movement position value Ps is below the lowest position Pd1, and proceed to ST23.

ST23: Reset the current movement position Ps to the value of the lowest position Pd1 (Ps=Pd1), and then proceed to ST27.

ST24: Check whether the control cycle count Sc has reached a certain preset reference control cycle count So, or not. When it is YES, proceed to ST25, and when NO, proceed to ST27. The reference control cycle count is "5," for example.

ST25: Check whether the movement position Ps has reached a preset imaginary upper limit value Pu2, that is, has increased to Pu2 or not (Ps≧Pu2). When it is YES, proceed to ST26, and when NO, proceed to ST27. The imaginary upper limit value Pu2 is greater than the highest position Pu1 (Pu2>Pu1). The imaginary upper limit value Pu2 is "±9," for example.

ST26: Set the up output flag Fmu at 0, and then proceed to ST51 in FIG. 8C.

ST27: Set the up output flag Fmu at 1, and then proceed to ST51 in FIG. 8C.

ST31: Check whether the control lever 46A is moved to the down position or not, based on the switch signal from the switch 100. When it is YES, proceed to ST32, and when NO, proceed to ST41.

ST32: Check whether the current vertical movement position Ps is lower than or equal to the preset highest position Pu1 or not (Ps≦Pu1). When it is YES, proceed to ST34. When NO, determine that the current position count value Ps is above the highest position Pu1, and proceed to ST33. The highest position Pu1 is "7," for example.

ST33: Reset the current movement position Ps to the value of the highest position Pu1 (Ps=Pu1), and then proceed to ST37.

ST34: Check whether the control cycle count Sc has reached the certain preset reference control cycle count So, or not. When it is YES, proceed to ST35, and when NO, proceed to ST37.

ST35: Check whether the movement position Ps has decreased to a preset imaginary lower limit value Pd2 or not (Ps≦Pd2). When it is YES, proceed to ST36, and when NO, proceed to ST37. The imaginary lower limit value Pd2 is smaller than the lowest reference value Pd1 (Pd2<Pd1). The lower limit value Pd2 may be "−2.5," for example.

ST36: Set the down output flag Fmd at 0, and then proceed to ST51 in FIG. 8C.

ST37: Set the down output flag Fmd at 1, and then proceed to ST51 in FIG. 8C.

ST41: Set the up output flag Fmu at 0, and then proceed to ST42.

ST42: Set the down output flag Fmd at 0, and then proceed to ST51 in FIG. 8C.

Figure 8C:
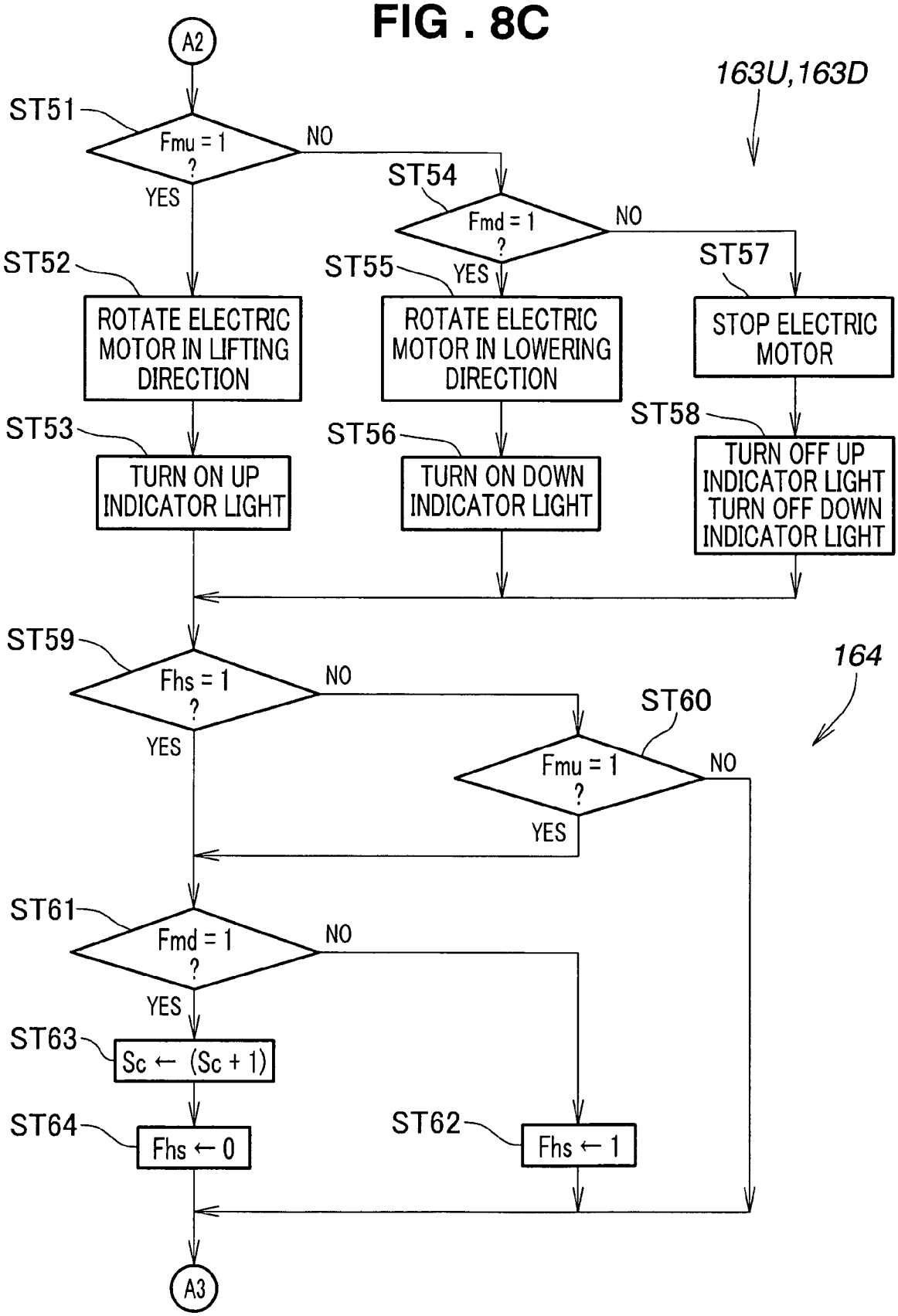

In FIG. 8C, ST51: Check whether the up output flag Fmu is 1 or not. When it is YES, proceed to ST52, and when NO, proceed to ST54.

ST52: Rotate (normally rotate) the electric motor 85 in an auger lifting direction. Specifically, only the auger lifting relay 120 in FIG. 6 is turned on.

ST53: Turn on (light) only the up indicator light 141, and then proceed to ST59.

ST54: Check whether the down output flag Fmd is 1 or not. When it is YES, proceed to ST55, and when NO, proceed to ST57.

ST55: Rotate (reversely rotate) the electric motor 85 in an auger lowering direction. Specifically, turn on only the auger lowering relay 130 in FIG. 6.

ST56: Turn the down indicator light 142 on, and then proceed to ST59.

ST57: Stop the electric motor 85. Specifically, turn off the relays 120, 130.

ST58: Turn off (light off) the up indicator light 141 and the down indicator light 142, and then proceed to ST59.

ST59: Check whether the half cycle flag Fhs is 1 or not. When it is NO, proceed to ST60, and when YES, proceed to ST61.

ST60: Check whether the up output flag Fmu is 1 or not. When it is YES, proceed to ST61, and when NO, proceed to ST71 in FIG. 8D.

ST61: Check whether the down output flag Fmd is 1 or not. When it is NO, proceed to ST62, and when YES, proceed to ST63.

ST62: Invert the half cycle flag Fhs to 1, and then proceed to ST71 in FIG. 8D.

ST63: Add one to the control cycle count Sc (Sc=Sc+1).

ST64: Invert the half cycle flag Fhs to 0, and then proceed to ST71 in FIG. 8D.

Figure 8D:
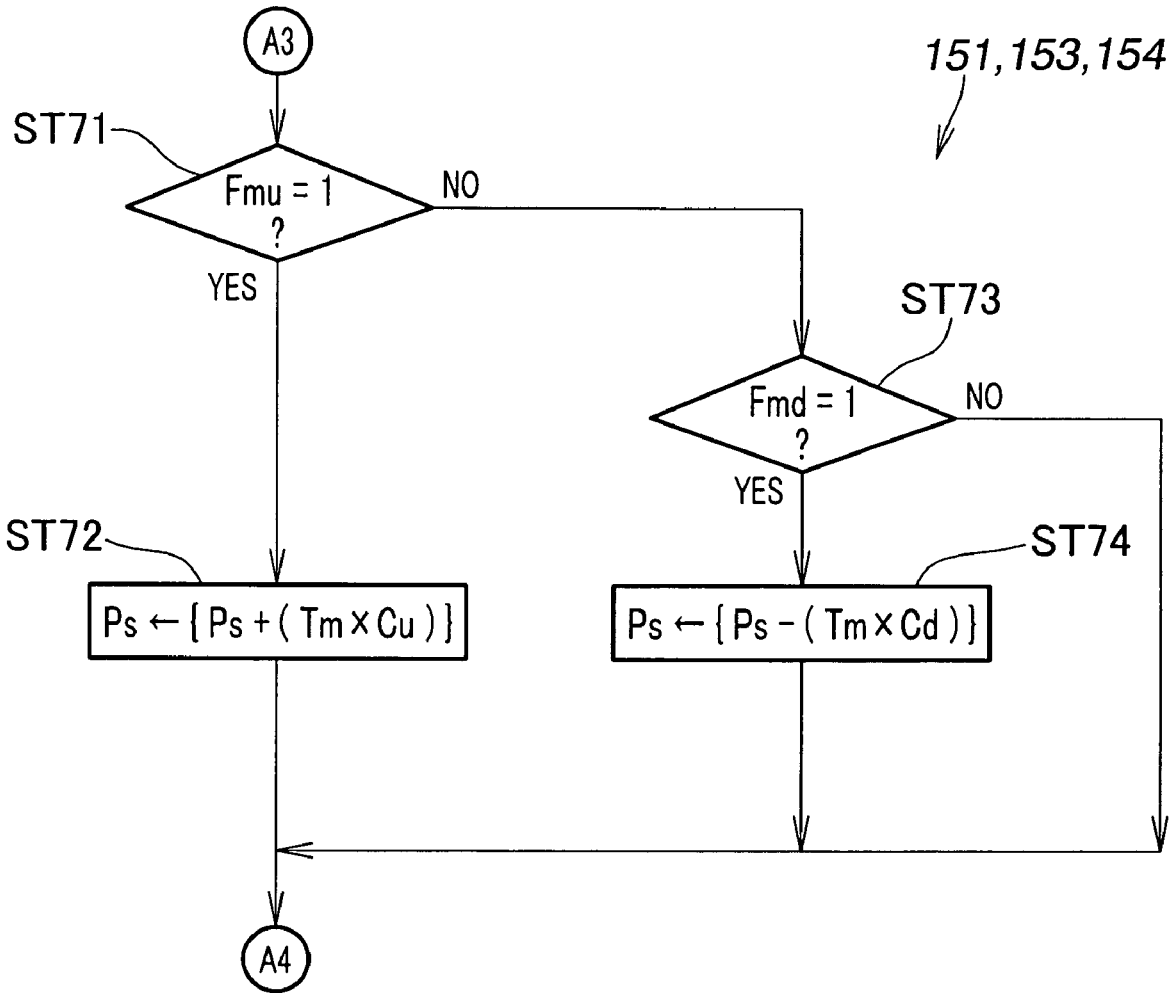
Figure 9:
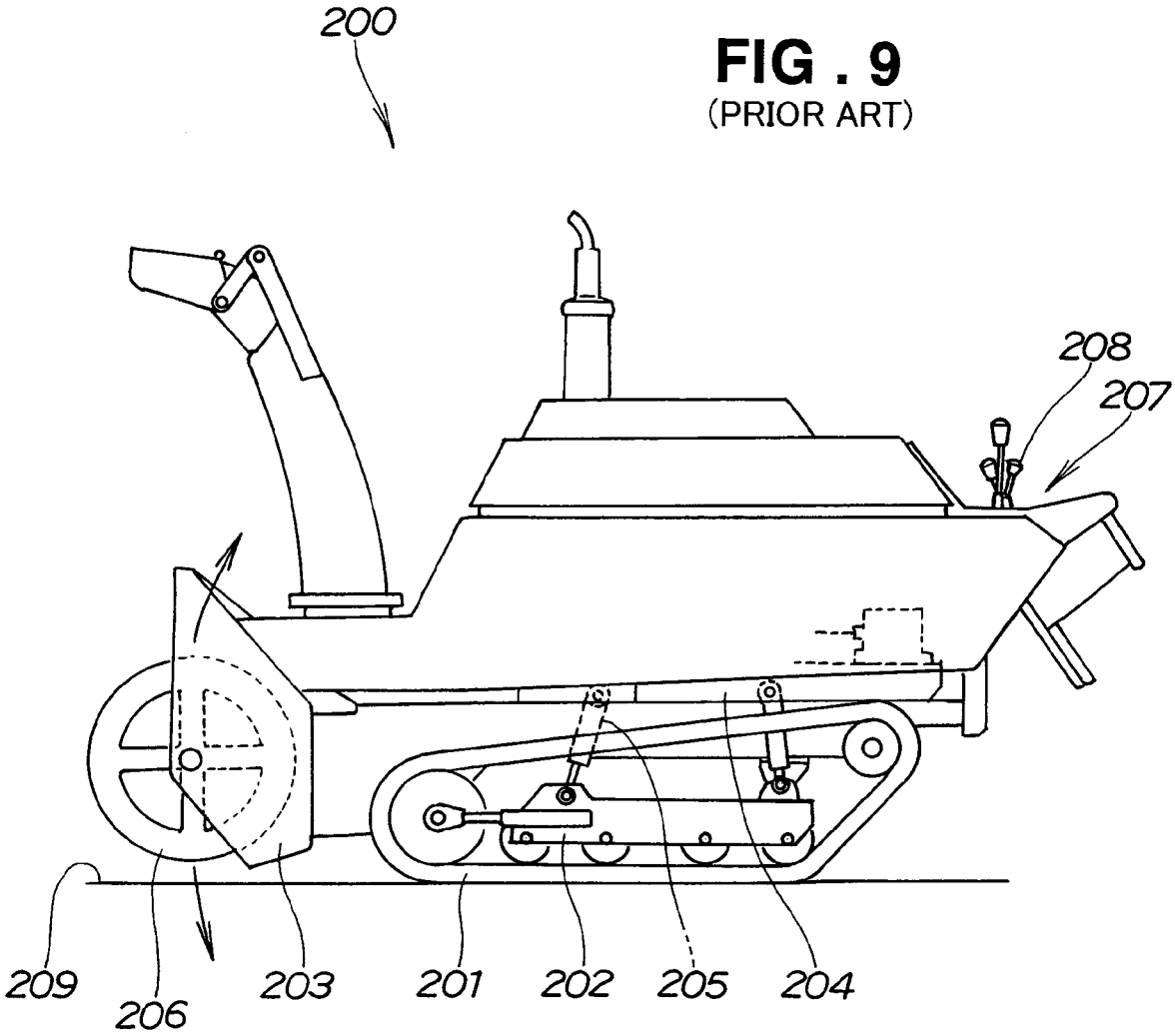
FIG . 9 (PRIOR ART)
FIG. 9 is a side view of a conventional auger-type snow removing machine.

In FIG. 8D, ST71: Check whether the up output flag Fmu is 1 or not. When it is YES, proceed to ST72, and when NO, proceed to ST73.

ST72: Determine the current movement position Ps at the time of lifting, and then return to ST02 in FIG. 8A. More specifically, determine the movement position Ps by the following expression (1):

$$Ps=Ps+(Tm\times Cu) \quad (1)$$

where, Tm: a certain time;

Cu: a for-lifting constant (Cu=1.0).

A time required to complete the control flow shown in FIGS. 8A to 8D one time, that is, a period of one cycle corresponds to the certain time Tm. Thus, the period of passing through "ST72" corresponds to the certain time Tm. The certain time Tm is 10 msec., for example. A value of the certain time Tm multiplied by the for-lifting constant Cu is an amount of change ΔPs of the movement position.

Each time "ST72" is passed, the change amount ΔPs is added to the last movement position Ps, so that the current movement position Ps can be determined.

ST73: Check whether the down output flag Fmd is 1 or not. When it is YES, proceed to ST74, and when NO, return to ST02 in FIG. 8A.

ST74: Determine the current vertical movement position Ps during lowering, and then return to ST02 in FIG. 8A. More specifically, the position Ps is determined by the following expression (2):

$$Ps=Ps-(Tm\times Cd) \quad (2)$$

where, Tm: a certain time;

Cd: a for-lowering constant (Cd=1.25).

The value of the certain time Tm multiplied by the for-lowering constant Cd is an amount of change ΔPs of the movement position. Each time "ST74" is passed, the change amount ΔPs is subtracted from the last movement position Ps, so that the current movement position Ps can be determined.

Now, the above description will be summarized as follows.

As shown in FIGS. 1 and 6, the snow removing machine 10 has the auger housing 26*a* provided with the auger 31 and mounted vertically swingably to the travel frame 12 provided with the travel wheels 23R, 23L, 24R, 24L. The auger housing 26*a* is vertically moved by the auger housing lifting-lowering mechanism 16. The auger housing lifting-lowering mechanism 16 comprises an electrohydraulic cylinder in which a piston rod 82 is telescopically moved by a hydraulic pressure generated by the electric motor 85. The control unit 28 controls the electric motor 85 upon receipt of a control signal from the control member 100 such that the piston rod 82 moves telescopically.

The control unit 28 in this invention is characterized as including a constant setting means 151 (see FIG. 8D), a (first) time measurement starting point setting means 152U at the time of lifting (see FIG. 8B), a (second) time measurement starting point setting means 152D at the time of lowering (see FIG. 8B), a timer means 153, and a vertical movement position estimating means 154 (see FIG. 8D).

The constant setting means 151 includes ST72, ST74 shown in FIG. 8D, and presets, as the constants Cu, Cd, the per-unit-time distances of movement, which are determined by the movable range Si (see FIG. 7B) in which the auger housing 26*a* can move between the lowest position Pd1 and the highest position Pu1, and the full lifting or lowering time Tu, Td (see FIG. 7B) required for the auger housing to vertically move the full range.

The time measurement starting point setting means 152U at the time of lifting includes ST21, ST23 and ST27 shown in FIG. 8B, and sets the lowest position Pd1 as the lifting time Tc (see FIG. 7A) measurement starting point (ST23) upon lifting of the auger housing 26*a* (ST21, ST27).

The time measurement starting point setting means 152D at the time of lowering includes ST31, ST33 and ST37, and sets the highest position Pu1 as the lowering time Tc (see FIG. 7B) measurement starting point (ST33) when the auger housing 26*a* is lowered (ST31, ST37).

The timer means 153 shown in FIG. 8D includes ST21, ST31, ST71 to ST74, and measures the lifting or lowering time Tc (see FIGS. 7A and 7B) from the corresponding measurement starting point Pd1, Pu1 (ST72, ST74), in accordance with the up or down control of the vertical movement control means 100 (ST21, ST31, ST71, ST73).

The vertical movement position estimating means 154 (see FIG. 8D) includes ST72, ST74, and estimates the current vertical movement position Ps by multiplying the obtained lifting or lowering time Tc (see FIG. 7A) by the constant Cu, Cd.

"Lifting movement position Ps=Ps+(Tm×Cu)" obtained in ST72 above corresponds to the value obtained by "Tc×Cu" shown in FIG. 7A. Also, "lowering movement position Ps=Ps−(Tm×Cd)" obtained in ST74 above corresponds to the value obtained by "Tc×Cd" shown in FIG. 7B. While Tm is a certain minute time, Tc is an accumulated time (elapsed time). Therefore, ST72 and ST74 can be said to be part of the timer means 153 for measuring the lifting or lowering time Tc (see FIGS. 7A and 7B).

The control unit 28 configured like this enables constant detection of the movement position (height) Ps of the auger housing 26*a* without providing a position sensor. Consequently, the snow removing machine 10 can be reduced in the number of components.

Although no position sensor is provided, the electric motor 85 can be stopped at the lowest position Pd1 and the highest position Pu1 of the auger housing 26*a*. As a result, application of an excessive load to the electrohydraulic cylinder 16 can be reduced to a minimum, so that sufficient durability of the electrohydraulic cylinder 16 can be ensured.

Further, without position sensors, the vertical movement position Ps of the auger housing 26*c* can be reliably detected without being affected by snow, water drops or the like.

Furthermore, the electric motor can be quickly stopped without operating the thermo-breaker 86 included in the electric motor 85. The control by time without depending on the thermo-breaker 86 having a long recovery time can shorten a time before the electric motor 85 is restarted. A snow removing operation can be continued without regard for the recovery time of the thermo-breaker 86, so that a snow removing operation can be done more smoothly.

In addition, a group of ST01 and ST03 to ST07 as shown in FIG. 8A constitutes a position initializing means 161U upon lifting. A group of ST01 and ST08 to ST12 constitutes a position initializing means 161D upon lowering.

At the point of time when the main switch 45B (see FIG. 3) is turned on and the control unit 28 starts to control, the control unit 28 does not recognize the movement position Ps of the auger housing 26*a*. It takes the full lifting or lowering time Td or Tu for the auger housing 26*a* to fully move between the lowest position Pd1 and the highest position Pu1. For example, Tu=7 sec. for lifting and Td=5.6 sec. for lowering. Therefore, by lifting or lowering the auger housing 26*a* for a time corresponding to the full lifting or lowering time Tu, Td, the initial positioning can be properly done. Thus, at the initial stage, the auger housing 26*a* is made to continue moving vertically for a time of 7 sec. which corresponds to the full lifting or lowering time Tu, irrespective of where the actual movement position Ps of the auger housing 26*a* is.

Specifically, the initial movement position Ps is set at 2 (ST01), and when the movement position Ps reaches the highest position Pu1 or the lowest position Pd1, depending on lifting or lowering (ST05, ST10), the movement position Ps is set at 5 once (ST06, ST11). This causes the auger housing 26*a* to continue vertical movement for a time of 7 sec. which corresponds to the full lifting or lowering time Tu. As a result, the movement position Ps can be set at the lowest position Pd1 or the highest position Pu1.

As is clear from the above description, the position initializing means 161U, 161D at the time of lifting or lowering sets the movement position Ps of the auger housing 26*a* immediately after the control unit 28 starts control, that is, at the initial stage, at the lowest position Pd1 or the highest position Pu1. With this, the current movement position Ps can be precisely determined.

Also, in FIG. 8B, a group of ST21 to ST23 constitutes a lower limit reset means 162D. A group of ST31 to ST33 constitutes an upper limit reset means 162U.

The lower limit reset means 162D resets the current position count value Ps to the lowest position value Pd1 (ST23) when the current position count value Ps is below the lowest position Pd1 (ST22) and the vertical movement control member 100 is operated for lifting (ST21).

The upper limit reset means 162U resets the current movement position Ps to the highest position value Pu1 (ST33) when the current position count value Ps is above the highest position Pu1 (ST32) and the vertical movement control member 100 is operated for lowering (ST31).

Upon lifting of the auger housing 26*a*, when the current movement position value Ps becomes higher than the highest position Pu1 and a lowering operation is performed, the current movement position Ps is reset to the highest position value Pu1. For lowering the auger housing 26*a*, the movement position Ps can be reckoned counting from the highest position Pu1.

Upon lowering of the auger housing 26*a*, when the current movement position value Ps becomes lower than the lowest position Pd1 and a lifting operation is performed, the current movement position Ps is reset to the highest position value Pu1. For lifting the auger housing 26*a*, the movement position Ps can be reckoned by counting from the highest position Pu1.

Even when the lifting or lowering speed of the auger housing 26*a* is lowered for some reason, the current movement position Ps can be precisely determined. Consequently, the movement position Ps of the auger housing 26*a* can be always located properly, so that a snow removing operation can be done further smoothly.

Also, in FIGS. 8B and 8C, a group of ST25, ST26, ST51 and ST57 constitutes an upper limit stop means 163U. A group of ST35, ST36, ST51 and ST57 constitutes a lower limit stop means 163D.

The upper limit stop means 163U stops the electric motor 85 rotating in an auger lifting direction (ST26, ST51, ST57) on the condition that the current movement position value Ps has reached the preset imaginary upper limit value Pu2 (ST25), thereby to stop the lifting of the auger housing 26*a*.

The lower limit stop means 163D stops the electric motor 85 (ST36, ST54, ST57) on the condition that the current movement position value Ps has decreased to the preset imaginary lower limit value Pd2 (ST35), thereby to stop lowering of the auger housing 26*a*.

Accordingly, when the auger housing 26*a* is at the lowest position Pd1 or at the highest position Pu1, the electric motor 85 can be properly stopped.

Also, in FIGS. 8B and 8C, a group of ST24, ST34, ST59 to ST64 constitutes a very low temperature initial handling means 164.

The very low temperature initial handling means 164 counts the lifting operation and lowering operation of the auger housing 26*a* (ST59 to ST64), and stops the operation of the upper limit stop means 163U and the lower limit stop means 163D until a condition that the count has reached a certain number is satisfied (ST24, ST34).

As a matter of fact, the snow removing machine 10 is used in cold climates. Oil used in the auger housing lifting-lowering mechanism 16 has high viscosity at a low temperature. Consequently, the speed of telescopic movement of the piston rod 82 becomes relatively low, so that the movement speeds of the auger housing 26*a* are inevitably slow. Thus, if the upper limit stop means 163U or the lower limit stop means 163D operates, the auger housing 26*a* is stopped midway of movement.

To deal with this, the very low temperature initial handling means 164 is provided, so that the auger housing 26*a* can be lifted or lowered to the highest position Pu1 or the lowest position Pd1 at the will of an operator until the lifting and lowering is repeated a certain number of times. While the auger housing 26*a* is repeatedly moved up and down, the oil used in the auger housing lifting-lowering mechanism 16 is warmed, and the viscosity is reduced. Consequently, the extending and retracting speed of the piston rod 82 becomes a speed at normal times, so that the lifting and lowering speeds of the auger housing 26*a* can be speeds at normal times. Thereafter, the auger housing 26*a* can be moved up and down at more adequate lifting and lowering speeds.

In the embodiment of the present invention, the vertical movement control member 100 is not limited to the configuration in which the switch mechanism 101 is included in the control lever 46A, and has various configurations, and may be configured with two push button switches for lifting operation and lowering operation, for example.

As described above, the snow removing machine 10 of the present invention is such that the auger housing 26*a* is moved up and down by the auger housing lifting-lowering mechanism 16; the auger housing lifting-lowering mechanism 16 is constituted by an electrohydraulic cylinder of a type which extends and retracts the piston rod 82 by a hydraulic pressure generated by the electric motor 85; and the control unit 28 controls the electric motor 85 upon receiving a control signal from the up-and-down control member 100; and is suitable for determining the up-and-down position of the auger housing 26*a* without providing a position sensor.

What is claimed is:

1. A snow removing machine comprising:

a travel frame having travel wheels;

an auger housing having an auger and mounted on the travel frame for undergoing vertical movement;

a lifting-lowering mechanism for vertically lifting and lowering the auger housing, the lifting-lowering mechanism comprising an electrohydraulic cylinder having a piston rod telescopically movable by an electric motor;

a vertical-movement control member operable to output a control signal for a lifting or lowering operation of the auger housing; and a control unit for controlling the electric motor of the lifting-lowering mechanism in accordance with a control signal from the vertical-movement control member to thereby telescopically move the piston rod of the lifting-lowering mechanism, the control unit comprising constant setting means for presetting, as constants, per-unit-time distances of vertical movement of the auger housing, the per-unit-time distances being determined in accordance with a movable range in which the auger housing is allowed to move vertically between a lowest position and a highest position, and a full lifting or lowering time required for the auger housing to move vertically the full movable range;

first time measurement starting point setting means for setting the lowest position as a lifting time measurement starting point upon lifting of the auger housing;

second time measurement starting point setting means for setting the highest position as a lowering time measurement starting point upon lowering of the auger housing;

timing means for measuring, in accordance with a control signal from the vertical-movement control member for a lifting or lowering operation, a lifting or lowering time from the corresponding time measurement starting point; and vertical movement position estimating means for estimating a current vertical movement position by multiplying the lifting or lowering time measured by the timing means by a corresponding one of the constants preset by the constant setting means.

2. A snow removing machine as set forth in claim 1; wherein the control unit further comprises: upper limit reset means for resetting the current vertical movement position to a value of the highest position when the value of the current vertical movement position is above the highest position and the vertical movement control member is operated to output a control signal for a lowering operation; and lower limit reset means for resetting the current vertical movement position to a value of the lowest position when the value of the current vertical movement position is below the lowest position and the vertical movement control member is operated to output a control signal for a lifting operation.

3. A snow removing machine as set forth in claim 1; further comprising position initializing means for setting a movement position of the auger housing at the lowest position or the highest position immediately after the control unit starts a control operation.

4. A snow removing machine as set forth in claim 3; further comprising upper limit stop means for stopping operation of the electric motor when the movement position of the auger housing has reached a preset upper limit value to thereby stop a lifting operation of the auger housing; and lower limit stop means for stopping operation of the electric motor when the movement position of the auger housing has reached a preset lower limit value to thereby stop a lowering operation of the auger housing.

5. A snow removing machine as set forth in claim 1; further comprising stopping means for stopping operation of the electric motor when the current vertical movement position estimated by the vertical movement estimating means corresponds to the highest position or the lowest position of the auger housing.

6. A snow removing machine as set forth in claim 1; further comprising setting means for setting a first limit value smaller than a value of the lowest position of the auger housing and for setting a second limit value greater than a value of the highest position of the auger housing.

7. A snow removing machine as set forth in claim 6; further comprising stopping means for stopping operation of the electric motor to stop vertical movement of the auger housing when the vertical movement position of the auger housing has reached the first limit value or the second limit value.

8. A snow removing machine as set forth in claim 1; wherein the movable range of the auger housing is determined by a maximum stroke of the piston rod of the lifting-lowering mechanism.

9. A snow removing machine as set forth in claim 1; wherein the electric motor is integrated with a side portion of the electrohydraulic cylinder of the lifting-lowering mechanism.

10. A snow removing machine as set forth in claim 1; further comprising a body frame mounted on the travel frame for undergoing vertical movement relative to the travel frame; and wherein the auger housing is mounted on the body frame for vertical movement therewith.

11. A snow removing machine as set forth in claim 10; wherein the lifting-lowering mechanism has a first end pivotally attached to the travel frame and a second end opposite the first end and pivotally attached to the body frame.

12. A snow removing machine comprising:

a travel frame having travel wheels for supporting the travel frame on a travel surface during a snow removal operation;

a body frame having a snow removing portion for removing snow during a snow removal operation, the body frame being mounted on the travel frame for undergoing movement within a movable range in which the snow removing portion moves between lowered and lifted positions relative to the travel surface;

a moving mechanism for moving the body frame relative to the travel frame within the movable range;

a control member operable to output a control signal for a lifting or lowering operation of the snow removing portion; and a control unit for controlling the moving mechanism in accordance with a control signal from the control member to thereby lift or lower the snow removing portion relative to the travel surface, the control unit comprising constant setting means for presetting, as constants, per-unit-time distances of movement of the snow removing portion, the per-unit-time distances being determined in accordance with the movable range of the body frame, and a full lifting or lowering time required for the snow removing portion to move the full movable range; first time measurement starting point setting means for setting a lowest position of the snow removing portion as a lifting time measurement starting point upon lifting of the snow removing portion; second time measurement starting point setting means for setting a highest position of the snow removing portion as a lowering time measurement starting point upon lowering of the snow removing portion; a timer that measures in accordance with a control signal from the control member for a lifting or lowering operation, a lifting or lowering time from the corresponding time measurement starting point; and movement position estimating means for estimating a current movement position by multiplying the lifting or lowering time measured by the timer by a corresponding one of the constants preset by the constant setting means.

13. A snow removing machine according to claim 12; wherein the moving mechanism comprises an electrohydraulic cylinder having a cylinder, a piston rod, and a drive source for extending and retracting the piston rod from and into the cylinder to move the snow removing portion within the movable range.

14. A snow removing machine according to claim 13; wherein the cylinder has an end portion pivotally connected to the travel frame, and the piston rod has an end portion opposite to the end portion of the cylinder and connected to the body frame.

15. A snow removing machine as set forth in claim 13; wherein the drive source comprises an electric motor integrated with a side portion of the cylinder.

16. A snow removing machine as set forth in claim 13; further comprising position initializing means for setting a movement position of the snow removing portion at the lowest position or the highest position thereof immediately after the control unit starts a control operation.

17. A snow removing machine as set forth in claim 16; further comprising upper limit stop means for stopping operation of the drive source when the movement position of the snow removing portion has reached a preset upper limit value to thereby stop a lifting operation of the snow removing portion; and lower limit stop means for stopping operation of the drive source when the movement position of the snow removing portion has reached a preset lower limit value to thereby stop a lowering operation of the snow removing portion.

18. A snow removing machine as set forth in claim 13; further comprising stopping means for stopping operation of the drive source when the current vertical movement position estimated by the vertical movement estimating means corresponds to the highest position or the lowest position of the snow removing portion.

19. A snow removing machine as set forth in claim 13; further comprising setting means for setting a first limit value smaller than a value of the lowest position of the snow removing portion and for setting a second limit value greater than a value of the highest position of the snow removing portion.

20. A snow removing machine as set forth in claim 19; further comprising stopping means for stopping operation of the drive source to stop movement of the snow removing portion when the movement position of the auger housing has reached the first limit value or the second limit value.

* * * * *